US006026385A

United States Patent [19]

Harvey et al.

[11] Patent Number: 6,026,385

[45] Date of Patent: Feb. 15, 2000

[54] ENCRYPTED POSTAGE INDICIA PRINTING FOR MAILER INSERTING SYSTEMS

[75] Inventors: George B. Harvey, New Canaan; Feliks Bator, Easton; Michael Y. Swaluk, Redding, all of Conn.

[73] Assignee: Pitney Bowes Inc., Stamford, Conn.

[21] Appl. No.: 08/897,480

[22] Filed: Jul. 21, 1997

[51] Int. Cl.[7] ..... G07B 17/00

[52] U.S. Cl. ..... 705/408; 705/401; 705/410

[58] Field of Search ..... 270/32, 58.01; 364/478.01, 478.07, 478.08; 702/182, 183, 185; 705/401, 410, 408; 714/703, 712

[56] References Cited

U.S. PATENT DOCUMENTS

| | | | |
|---|---|---|---|
| 4,571,925 | 2/1986 | Adams | 53/502 |
| 4,639,873 | 1/1987 | Baggarly et al. | 705/406 |
| 4,649,266 | 3/1987 | Eckert | 235/432 |
| 4,734,865 | 3/1988 | Scullion et al. | 364/478.1 |
| 4,797,830 | 1/1989 | Baggarly et al. | 705/406 |
| 4,800,505 | 1/1989 | Axelrod et al. | 364/478.09 |
| 4,809,187 | 2/1989 | Adams | 705/406 |
| 4,835,713 | 5/1989 | Pastor | 364/519 |
| 4,853,869 | 8/1989 | Durst et al. | 364/478 |
| 4,959,795 | 9/1990 | Christensen et al. | 705/407 |
| 5,079,714 | 1/1992 | Manduley et al. | 364/478.07 |
| 5,118,369 | 6/1992 | Shamir | 156/64 |
| 5,119,306 | 6/1992 | Metelits et al. | 705/406 |
| 5,142,482 | 8/1992 | Sansone | 364/478.09 |
| 5,161,109 | 11/1992 | Keating et al. | 364/464.02 |
| 5,177,687 | 1/1993 | Baggerly et al. | 705/406 |
| 5,200,903 | 4/1993 | Gilham | 705/408 |
| 5,270,938 | 12/1993 | Sansone et al. | 705/406 |
| 5,317,654 | 5/1994 | Perry et al. | 209/384 |
| 5,367,450 | 11/1994 | Pintsov | 705/8 |
| 5,422,821 | 6/1995 | Allen et al. | 364/478 |
| 5,445,367 | 8/1995 | Long | 270/1.03 |
| 5,454,038 | 9/1995 | Cordery et al. | 380/23 |
| 5,480,239 | 1/1996 | Kim et al. | 400/120.09 |
| 5,535,127 | 7/1996 | Uno et al. | 364/464.02 |
| 5,538,232 | 7/1996 | Long | 270/1.03 |
| 5,550,958 | 8/1996 | Hattori | 395/115 |
| 5,572,010 | 11/1996 | Petrie | 235/494 |
| 5,606,507 | 2/1997 | Kara | 705/408 |
| 5,628,249 | 5/1997 | Cordery et al. | 101/91 |
| 5,650,934 | 7/1997 | Manduley | 364/478.03 |
| 5,666,284 | 9/1997 | Kara | 705/402 |
| 5,684,706 | 11/1997 | Harman et al. | 364/468.01 X |
| 5,822,739 | 10/1998 | Kara | 705/410 |
| 5,873,073 | 2/1999 | Bresnan et al. | 705/410 |

*Primary Examiner*—Edward R. Cosimano
*Attorney, Agent, or Firm*—Charles R. Malandra, Jr.; Michael E. Melton

[57] ABSTRACT

A post production processing application receives and manipulates document print images, in particular to integrate postage printing and accounting into the document finishing, without the need for a specialized postage printing system. The post production processing application may run on a main frame, together with the application(s) that generate the document print images, or on some other computer platform. The post production processing application calculates postage for each document and interacts with a postage metering functionality to obtain digital tokens. Each token includes an encrypted cipher for use in validating applied postage indicia. The mail processing system uses the tokens to generate postage indicias, containing the ciphers, during the subsequent document printing and finishing processes. The meter functionality may reside in software (e.g. as part of the post production processing application), in a meter device associated with and connected to the platform that runs the post production processing application or in a remote data center in communication with that platform. The mail processing system may print the indicias on the documents or on envelopes that will carry the documents.

19 Claims, 11 Drawing Sheets

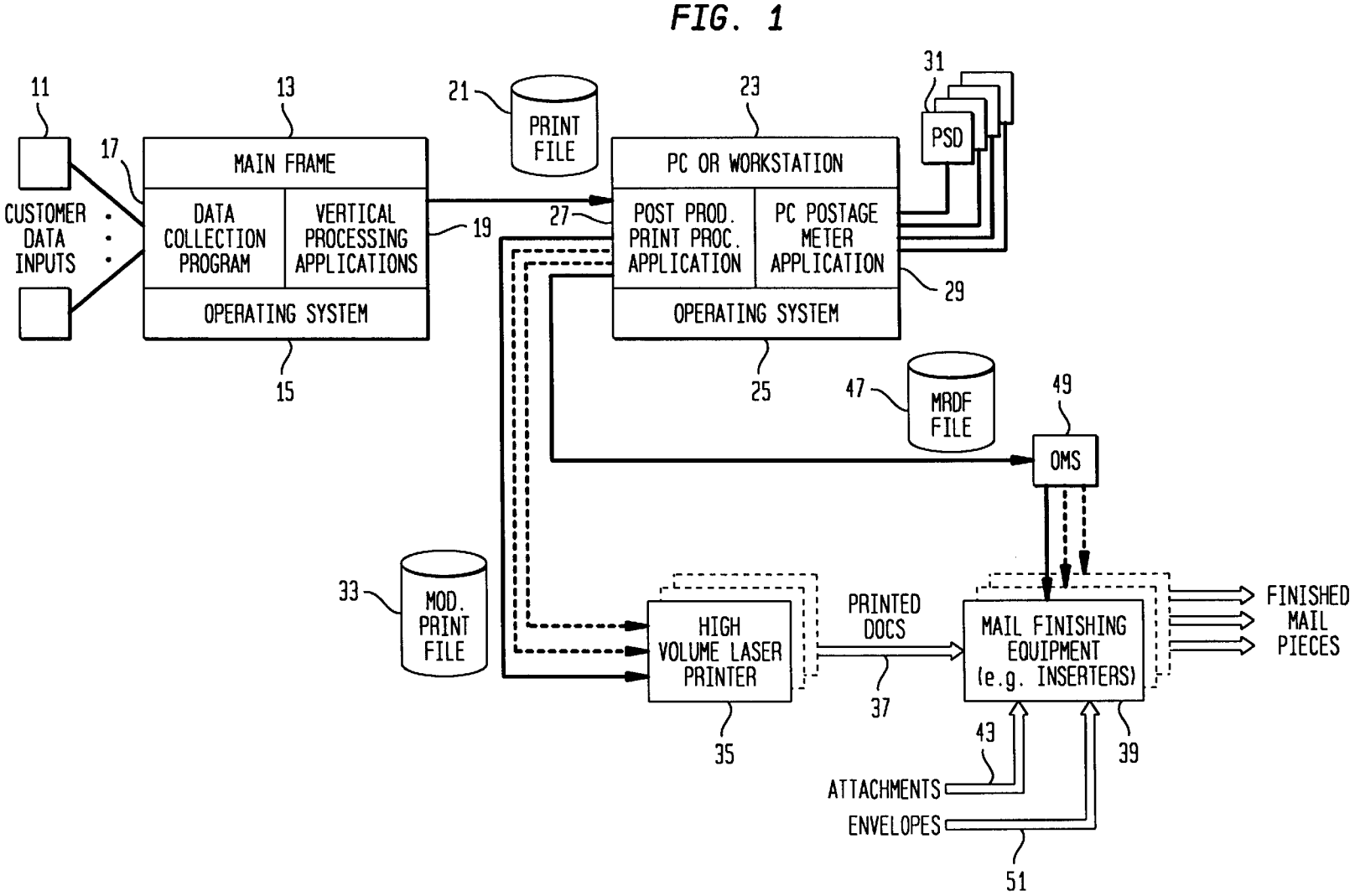
FIG. 1
11
CUSTOMER DATA INPUTS
17
13
MAIN FRAME
DATA COLLECTION PROGRAM
VERTICAL PROCESSING APPLICATIONS
OPERATING SYSTEM
15
19
21
PRINT FILE
27
23
PC OR WORKSTATION
POST PROD. PRINT PROC. APPLICATION
PC POSTAGE METER APPLICATION
OPERATING SYSTEM
25
29
31
PSD
47
MRDF FILE
49
OMS
33
MOD. PRINT FILE
35
HIGH VOLUME LASER PRINTER
37
PRINTED DOCS
39
MAIL FINISHING EQUIPMENT (e.g. INSERTERS)
43
ATTACHMENTS
51
ENVELOPES
FINISHED MAIL PIECES 31
POSTAL SECURITY DEVICE (PSD)
NON-VOLATILE MEMORY (ACCT. MOD.)
319
317
RAM
ROM
315
MICRO. PROC.
313
ENCRYPTION MODULE
321
PC INT
311
TO PRINTER(S) 35
23
PC OR WORKSTATION
PRINTER PORT
251
DRAM
243
ROM
241
MICRO. PROC.
239
DISPLAY DRIVER
231
DATA INT
253
244
BUS
PSD INT
257
MODEM
254
OTHER STORAGE MEDIA
249
FLOPPY DISK DRIVE
247
I/O PORTS
238
HARD DISK DRIVE
245
TELE. LINE OR OTHER LINK TO COMM. NTWK(S)
OTHER DEVICES
237
DISPLAY
233
KEYBOARD
235
TO/FROM MAIN FRAME

ENCRYPTED POSTAGE INDICIA PRINTING FOR MAILER INSERTING SYSTEMS

TECHNICAL FIELD

The present invention relates to digital postage indicia processing, particularly for mass mailing print images generated by batch processing on a main frame computer.

BACKGROUND

An automated mass mail processing system, typically built around a main frame computer, prints mail pieces (documents for mailing), folds the mail pieces, inserts the mail pieces in envelopes and may automatically print postage on the envelopes. Such a system typically includes the main frame computer, one or more high volume document printers, and some type of finishing equipment such as a folder and an inserter.

High volume mailers utilize existing batch processing applications, typically now referred to as 'legacy' systems because they are relatively old systems handed down from previous generations of company management. However, these systems still are effective and often control processing of data relating to a core element of a company's business, such as bill production. Such legacy systems for mass mailing document production run on a main frame computer and are complex and expensive, and mailers are reluctant to modify, upgrade or replace these critical document generation applications.

As a result, it is more effective to perform new functions in a post processing stage, after completion of a document file by the main application(s). StreamWeaver, by PDR Advanced Technology, is one example of an post production processing application, used to manipulate print images from batch document print files output by the legacy document generation applications running on a main frame computer. A post production processing application such as Streamweaver, for example, can perform address corrections, add zip+4 codes, add postal service bar codes, compile or sort unsorted documents per postal specifications, etc.

Typically, high volume mailing systems include a postage printing system, for printing digital indicias on the finished envelopes. The postage printing system is located downstream of the inserter, so as to print the postage indicia on each envelope after insertion of the documents. The postage printing system prints an indicia on each mail piece, based on certain parameters regarding the mail piece. There are several ways to derive the mail piece parameters and determine the appropriate postage amount for inclusion in the indicia.

In a first technique, the assembled mail piece in each envelope is weighed on the fly, as it exits from the inserter. Based on the weight and a configuration parameter (mail class), the postage is calculated. A postage meter downstream from the inserter then applies an indicia, including the calculated postage, to the envelope. The postage meter performs a number of secure accounting functions, to account for the postage applied to each individual mail piece. This approach requires a relatively complex and expensive type of meter and postage printing system, for example including a scale capable of weighing a large volume of mail pieces on the fly.

In a second approach, the inserter knows the various materials that go into a particular mail piece and are inserted into an envelope. For example, the inserter knows the number of document pages, the number and types of enclosures, and so on. Based on this information, the inserter can calculate the weight. The postage is calculated and applied to the envelope, as in the earlier example, but here using the weight calculated by the inserter.

In a third approach, the main frame uses the information about number and weight of pages and enclosures to calculate the weight. Based on the class and mail piece weight, the main frame calculates the postage for the mail piece. The main frame then passes the postage information to the inserter, and the inserter controls the postage meter to apply and account for the postage as in the earlier examples.

The calculation of the postage by the inserter or the main frame eliminates the need for physical weighing of each mail piece on the fly and thus eliminates the need for the scale. However, the mailing systems still must include a specialized postage printer capable of printing indicia at the high volume mail piece rate. Also, the calculations place added burdens on the controller of the inserter or on the legacy applications performing the document preparation in the main frame.

Thus, a need exists for a more efficient way to calculate, apply and account for postage in a mass mailing system. Also, a need exists for a postage processing technique which eliminates the need for a specialized postage printer.

DISCLOSURE OF THE INVENTION

The present invention addresses the above stated needs by providing an enhanced post production print processing application or print image manipulation application, which integrates a number of functions relating to postage processing. This application receives a print file from a document preparation application. The post processing application analyzes a print image of a document from that file to derive one or more parameter values relevant to mailing the document. The application calculates postage for the resulting mail piece based at least in part based on the derived parameter value(s). The post processing application also interacts with a secure postage meter to obtain a digital token providing the calculated amount of postage. The post processing application uses the digital token to control finishing of the mail piece containing the printed document, so that the mail piece includes a postal indicia bearing the postage value.

In one embodiment, the post processing application generates a print image of the indicia and merges the image of the indicia into the print image of the document. The post processing application supplies a modified print file to the printer, and the printer prints the document so as to include the indicia. The indicia is positioned on a cover page of the printed document to appear in a window of an envelope, so that the indicia is at least visible through the window and may be accessible for physical cancellation through the window.

Alternatively, the post processing application includes codes regarding the indicia in a control file, which the application supplies to an operations management system that controls the finishing equipment. In this embodiment, the finishing equipment includes an envelope printer and the operations management system supplies the control code to that printer to apply a postal indicia to the appropriate envelope, e.g. along with destination and/or origination addresses.

In the preferred embodiments, the enhanced post production processing operations apply to large numbers of documents included in print files for batch mailings. The post production processing application actually analyzes each document image within a batch print file, and performs the various postage related processing functions with respect to each document in the file. The application may perform a variety of other manipulations on the print images, for example to correct addresses, add zip codes, add postal bar codes, move addresses, etc. The application supplies a modified print file containing the final print images for the documents to a high speed printer, and the application supplies control codes for finishing the documents in a separate control file sent to the operations management system.

The present invention thus effectively integrates the postage processing and printing into the post production processing of print images, particular for batches of documents produced on a main frame computer for high volume mailers.

The post production processing application may run on the main frame that runs the actual document production applications or on a separate computer platform coupled to the main frame. Also, the invention encompasses use of a range of postage metering technologies. The post production application may obtain the digital tokens for postage from a software based metering system integrated with the application or running as another application on the main frame, the separate platform or in a remote data center. Alternatively, the main frame or the separate computer platform may connect to some type of postage meter vault, for example one or more postal security devices.

Other aspects of the invention encompass the processing methodology for print image analysis, obtaining a digital token and mail piece finishing with an indicia based on the digital token. Another aspect of the invention relates to application of this processing methodology to batch document processing. Aspects of the invention also relate to systems implementing these methodologies and to software products embodying the computer executable code for implementing the processing methodologies.

The software aspects encompass media or carrier waves bearing sequences of computer executable instructions for performing the steps of the invention. A computer readable medium, as used herein, may be any medium which can bear instructions or code for performing a sequence of steps in a machine readable form, such as a floppy disk, flexible disk, hard disk, magnetic tape, any other magnetic medium, a CD-ROM, any other optical medium, a RAM, a ROM, a PROM, an EPROM, a FLASH-EPROM, any other memory chip or cartridge. A carrier wave signal is any type of signal that may carry digital information representative of the instructions or code for performing a sequence of steps. Such a carrier wave may be received via a network, over a modem, or as a radio-frequency or infrared signal, or any other type of signal which a computer may receive and decode.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF DRAWINGS

The drawings depict the present invention by way of example, not by way of limitations. In the drawing figures, like reference numerals refer to the same or similar elements.

FIG. 1 is a simplified block diagram of a first embodiment of a high volume mailing system operating in accord with the principles of the present invention.

BEST MODES FOR CARRYING OUT THE INVENTION

Figure 2:
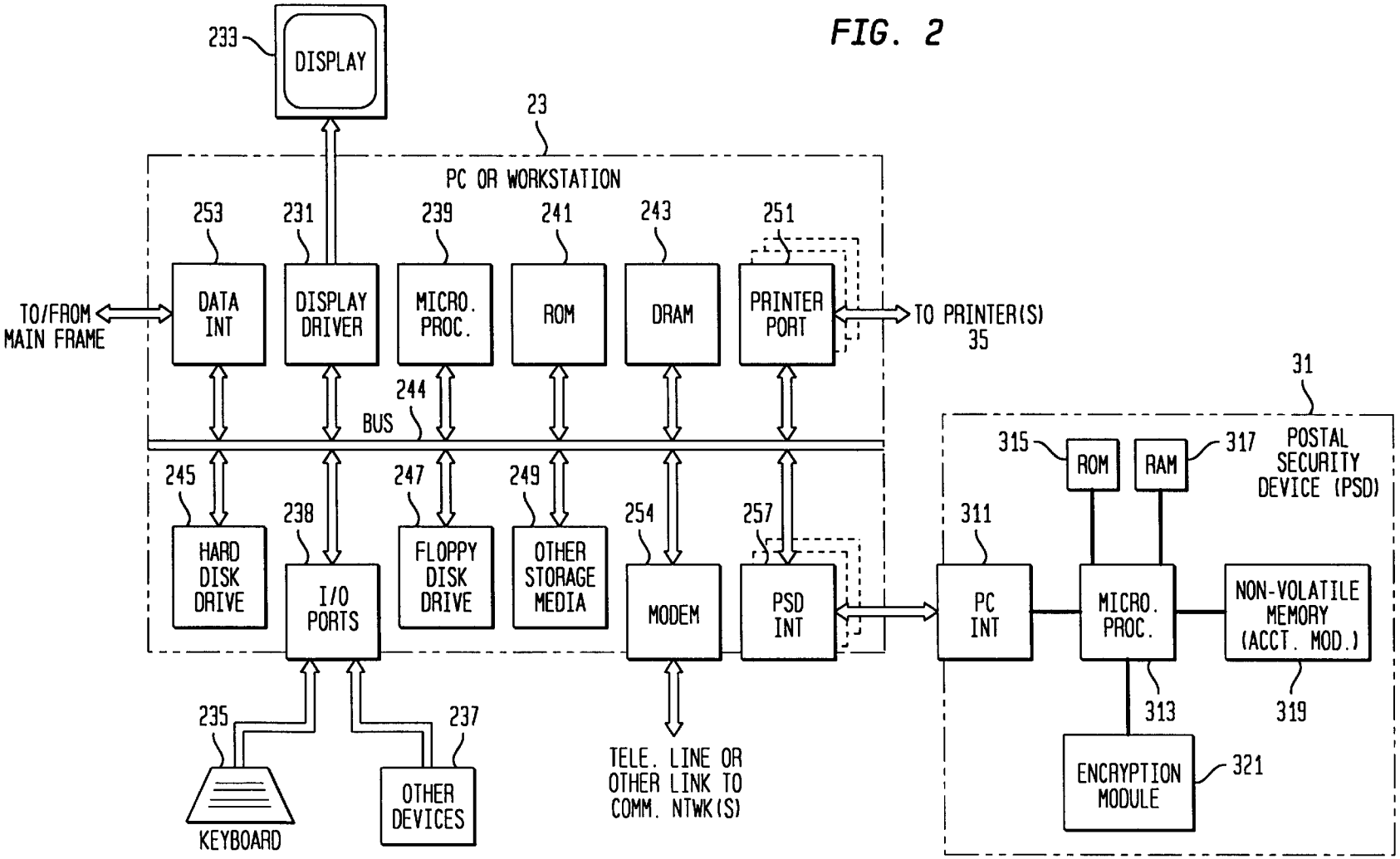
FIG. 2 is a block diagram of a computer platform and associated postal security device used for post production processing and postage processing in the system of FIG. 1.

The invention involves post production processing of document print images to integrate postage printing and accounting into the document finishing process, without the need for a specialized postage printing system. The post production processing relies on a processing application that may run on the main frame, with the application that generates the document print images, or on some other computer platform. The post production processing application analyzes each document image and calculates postage for each mail piece. The application interacts with a postage metering functionality to obtain digital tokens for use in generating postage indicias during the subsequent document printing and finishing process. The meter functionality may reside in software (e.g. as part of the post production processing application), in a meter device associated with and connected to the platform that runs the post production processing application or in a remote data center in communication with that platform. The system may print the indicias on the documents or on envelopes that will carry the documents. A number of embodiments of systems and methodologies embodying the invention are discussed in detail below, as examples.

FIG. 1 provides a block diagram illustration of the elements of a first large scale processing system, implemented around a main frame computer, and utilizing the concepts of the present invention. As shown in that drawing, the mailing system includes data input sources 11 enabling input of various customer data and related control information into a main frame computer 13, such as an IBM/370. The main frame computer 13 runs an operating system 15, and a number of applications programs run on top of that operating system program. Of note for purposes of this discussion, the application programs include a data collection program 17 for receiving the input data from the devices 11. One or more vertical processing applications 19 process the input data from collection program 17 and various stored information, to produce batch mailing files for printing.

The applications 19 facilitate batch processing to produce print files 21, containing large numbers of document images. In this instance, the print images represent documents for mailing, e.g. bills or advertisements and the like, for mass mailings to customers and/or prospective customers.

In accord with the present invention, a post production print processing application 27 processes the print files in such a manner as to enable electronic postage printing and accounting during the document printing and finishing operations. As discussed in more detail later, the post production print processing application 27 manipulates print images from a print file. The application supplies the resultant modified print file 33 to one or more high volume printers 35 and provides a control file 47 (referred to as a Mail Run Data File or 'MRDF') to control finishing equipment 39, such as one or more inserters. The automated high-speed mail processing system prints mail pieces (documents for mailing), folds the mail pieces, inserts the mail pieces in envelopes and automatically prints and accounts for postage.

The post production print processing application 27 may receive print files 21 from a number of different applications 19 running on the main frame 13. The post production processing application 27 analyzes the document images in a print file, calculates weight and postage for each document and obtains a digital token representing the necessary postage for each document. In the system of FIG. 1, the application 27 uses the digital tokens to modify the print images in order to print the documents with the indicias thereon. In a later described embodiment, the application provides instructions to an envelope printer to print the postage on envelopes which will receive the respective documents. The post production processing application 27 may run on any appropriate computer platform. In an embodiment discussed later, the post production processing application 27 runs as another application program in the main frame. Alternatively, the application may run on a separate computer platform.

In the implementation illustrated in FIG. 1, for example, the automated mailing system includes a PC or workstation type computer 23. The computer 23 is a programmable machine of the type generally illustrated in FIG. 2. The computer 23 runs an operating system program 25, such as UNIX or Windows (NT or 95) and application programs, which include the post production processing application 27 and a postage application, such a PC postage meter program 29. The computer 23 connects to the main frame 13. Through this connection, the post production processing application 27 receives print files 21 from the vertical processing application(s) 19 in the main frame. The computer 23 also connects to one or more postal security devices (PSDs) 31, and the postage meter application 29 communicates through this connection to request and receive digital tokens representing postage values for application to mail pieces.

FIG. 2 is a block diagram of the functional components of the PC or workstation type computer 23 together with one of the PSDs 31. The computer 23 may be a typical workstation or personal computer (PC), although other computer platforms may be used.

The main processing element of the PC or workstation computer 23 is a programmable central processing unit (CPU). In the illustrated example, the CPU is a microprocessor 239. The control code for certain basic functions of the microprocessor are stored in a read only memory (ROM) 241. The PC or workstation computer 23 also includes one or more working memories, such as the dynamic random access memory (DRAM) 243, cache memory (not shown) and the like. The microprocessor runs programs loaded into the DRAM 243 from other storage devices.

To store programs, the computer 23 includes a number of different bulk storage systems. In the illustrated example, the computer 23 includes a hard disk drive 245 and one or more floppy disk drives 247, and the computer may include other storage media 249, such as a CD ROM drive, a digital tape drive or the like.

An internal bus system 244 provides two way data communications between the various elements of the PC or workstation computer 23. In particular, the microprocessor 239 receives digital signals from and sends a variety of digital signals to the other computer components via the bus 244.

The computer 23 typically connects through a display driver 231 to a display 233, such as a color cathode ray tube (CRT) type monitor. A user operates a keyboard 235 or another type of input device 237, such as a mouse, trackball or joystick, to input various information to the computer 23. The input devices 235, 237 connect to the computer 23 through appropriate input ports, represented by the block 238 in the drawing.

The operating system program allows the microprocessor 239 to respond to signals from the input devices 235, 237 and produce signals through the driver 231 and provide outputs on display 233, to effectuate a desired user interface. For example, a computer running a Windows type operating system provides a graphical user interface, for the operating system functions as well as for applications running on the operating system. The operating system also enables the microprocessor to execute various application programs.

The computer includes one or more systems enabling communication with other data systems. In the illustrated example, the computer includes one or more high speed printer ports 251 coupled to the bus 244. These ports provide direct connections to the high speed printers 35 (FIG. 1), for example to enable the post production print processing application to send modified print files 33 to the printers. The computer 23 also includes one or more data interfaces 253, to enable communications with the main frame 13 and the operations management system (OMS) 49. The data interfaces may be direct connections, such as parallel ports, or these interfaces may use a shared network interface, such as a local area network (LAN) interface which enables communication with networked data devices.

In the embodiment illustrated in FIGS. 1 and 2, for example, a vertical processing application 19 running on the main frame 19 would transmit a print file 21 over the appropriate connection or network to the interface 253 and through the bus 244 to the post production print processing application 27 running in the microprocessor 239. After the operations of the post production print processing application 27, that application would send an MRDF control file 47 through the bus 244, the interface 253 and the appropriate connection or network to the OMS 49.

The PC or workstation computer 23 also includes a modem 254 (or other communication interface) coupled to the bus 244. The modem 254 provides a two-way data communication coupling to a telephone line or other communication network link. The modem 254 sends and receives electrical, electromagnetic or optical signals which carry digital data streams representing various types of information in the format appropriate to the particular link.

In a mail processing system, such as illustrated in the drawings, the communications through the modem 254 and the connected network link(s) enable communication with a postal service computer to request and receive downloads of postage, to refill or recharge the PSD 31. This communication link may also permit downloading of various data files, such as rate tables, as well as downloading of software programs for the various computer platforms. In accord with the invention, some of the downloaded programs might include the post production print processing application 27, the postage meter application 29 as well as applications for the main frame, such as patches or complete copies of one or more of the vertical processing applications 19.

The computer 23 can receive a new application via the modem 254 or via an insertable storage media, such as a floppy in drive 247 or a tape or CD in another drive 249. When a new program is loaded, the microprocessor loads the received code from the drive 247, 249 or the modem 254, typically onto the hard disk storage 245. In this manner, the computer 23 may obtain application code in the form of a carrier wave, or the computer may obtain application code as data stored on a floppy disc, a compact disc or other transportable media. If the code represents an application program, the microprocessor 239 later loads the code into random access memory 243 for execution.

FIG. 2 also depicts the structure of an exemplary postal security device. For postage processing, the computer 23 includes an interface 257, such as a serial interface port, for coupling to a PSD 31. Depending on the processing speed of the PSD, it may be necessary to access a number of such devices in some multiplexed fashion, to provide the number of digital tokens at the rates necessary for the batch mail processing. Although not shown in FIG. 2, in such a case, the computer 23 would have an appropriate number of the PSD interfaces 257.

Each such PSD interface provides a connection to a corresponding interface port 311 in the PSD. The PC interface 311 in the PSD 31 and the connection thereof to the PSD interface 257 within the PC or workstation 23 enable two-way data communication, principally to enable the computer 23 to request digital postage tokens and to enable the PSD to return requested tokens and related response messages to the computer 23.

The PSD 31 also is an intelligent, secure device built around a programmable CPU, such as microprocessor 313. The PSD 31 includes a ROM 315, connected to the microprocessor 313, for supplying the program code which controls operations of the PSD 31. The PSD also includes a RAM 317 which the microprocessor uses as a working storage area during data processing.

A non-volatile memory 319, such as a battery backed-up RAM or an electrically erasable read only memory (EEPROM), serves as the postage accounting module. The microprocessor 313 and non-volatile memory 319 in the PSD 31 perform postage value accounting functions with respect to the postage requested for the batch mail items through the PC or workstation 23. Typically, postage accounting functions include maintaining ascending and descending register values, maintaining a piece count, maintaining one or more control registers, etc. The descending register, for example, contains the value of postage remaining in the PSD.

The microprocessor 313 also connects to an encryption engine or module 321 in the PSD. The encryption module receives certain data from the microprocessor 313, and in response, produces a series of digital characters representing a cipher based on the data. The microprocessor 313 uses the encryption module to perform a variety of encryption functions, including generation of digital signatures or tokens for inclusion in postage indicias and for inclusion in data messages exchanged with a postal service data center during recharging of the postage value in the PSD 31.

In an actual postage printing operation, the post production print processing application 27 calculates the weight of the mail piece, accesses the appropriate rate table based on the selected class of mail for the particular batch mail job and calculates the postage for a mail piece. The application 27 supplies the postage value and certain mail piece data to the meter software application 29 within the PC or workstation 23. The meter application 29 in turn supplies the postage value through the appropriate interfaces to the microprocessor 313 of the PSD 31. The microprocessor 313 deducts the requested postage value from the descending register value and writes the new balance into that register in memory 319. The microprocessor also updates the other registers. The PSD generates a digital token for use in printing a postage indicia in accord with the appropriate postal specifications and supplies digital signals representing the token to the PC or workstation 23. The meter application software 29 receives the digital token and supplies it to the post production print processing application 27, for use in finishing the mail piece to include a printed indicia based in part on the digital token.

The postage value stored in the descending register of the PSD 31 may be recharged to add new postage purchased by the mailer. The postal service could recharge the PSD during an operation wherein the PSD is coupled to a computer operated by the postal service. Preferably, the PC or workstation 23 can provide electronic communication between the PSD 31 and a data center operated by the postal service, to recharge the PSD 31.

Consider now the application 27. A variety of basic post production processing applications may be adapted to serve as the application 27, within the scope of the invention. For example, the application may be a version of a commercially available application identified as 'Streamweaver' supplied by PDR Advanced Technology, modified to operate in accord with the invention.

The post production processing application 27 receives print files 21 from the main frame 13, in a variety of different formats. The application 27 need not know anything about which application 19 created each particular file. The post production print processing application 27 unpacks the information in a print file from the main frame, to gain access to any or all of the contents of the file and then converts the contents into a standard internal format for further manipulation by the application program 27. Based on a script or instructions from the user, the application program 27 can remove information from the document, add information to the document, alter information, perform other post processing functions etc., before printing of the document. For mail processing, for example, the post production print processing application 27 performs address validation and correction. The application may add 3 of 9, OMR or other bar codes to the documents for a variety of purposes, such as control of which preprinted inserts to add to each document. The post production print processing application 27 also adds zip+4 or 11-digit zip codes to the addresses and adds postal service bar codes (e.g. POSTNET) to the mail pieces.

If desired, the post production print processing application 27 also can compile or sort unsorted documents per postal specifications, etc., by manipulating the order of the print images from the print file 21. This sorting operation eliminates the need to sort documents during the main frame application processing or to sort the physical documents after actual printing.

One product of the application program 27 is a modified print file 33. The modified print file includes elements from the original print file plus changes made by the program 27. The application program 27 transmits the modified print file 33 through an appropriate interface and connection lines to one of any number of high volume printer(s), such as laser printer(s) 35, which generate the actual printed documents 37 for mailing.

The post production processing application program 27 also produces a control file, referred to as an MRDF file 47. The MRDF file 47 contains control records. Each record provides control codes and related information for finishing the mail piece which will contain on of the documents from the modified print file 33.

In the illustrated mailing system, the computer 23 connects to another computer platform referred to as an operations management system (OMS) 49. The OMS 49 connects to one or more pieces of mail finishing equipment 39. The finishing equipment may include a variety of components such as folders and envelope printers, however, in this embodiment, the finishing equipment comprises one or more mail inserters, such as a 9 SERIES type inserter system sold by Pitney Bowes.

The OMS 49 performs a number of management functions relating to operations of the finishing equipment 39 and communications between that equipment and the other elements of the system. Of note for purposes of this discussion, the OMS 49 receives MRDF files 47 and supplies relevant portions thereof to the appropriate components of the finishing equipment.

In the system shown in FIG. 1, each inserter 39 receives a high speed stream of printed documents 37 from the laser printer(s) 35, as well as a stream of envelopes 51 and possibly other documents or attachments 43 for insertion into the envelopes along with the printed documents 37. In accord with control instructions received from the OMS 49, the inserter(s) 39 compile each of the documents together with any associated attachments, fold the compiled materials and insert the materials into envelopes.

To ensure synchronization between the MRDF control file 47 which controls operations of the finishing equipment 39 and the actual printed documents 37, each document image in the modified print file may include an image of a control code added to the first page of the print image by the application 27. The control code, printed on the first page of the document, may be a scannable numeric code or the like but preferably includes a bar code. The inserter 39 detects the bar code and compares the bar code to the control record that relates to the particular document from the MRDF file and then controls the finishing based on the verified control record.

As noted above, the post production print processing application 27 provides an MRDF control file 47 to the OMS 49. To produce this file, the application 27 reviews the documents in the print file 21 and compiles substantive information from each document. The application also analyzes the information from each document as part of its postage related functions.

The user or the mainframe provides information to the post production print processing application 27 identifying the class of mail for a particular batch print job. The post production print processing application 27 can detect page breaks in the print file. Using this feature, the application analyzes the print image of a document to determine the number of pages, and then calculates the weight based in part on the number of pages. The post production print processing application 27 can access a rate table stored in the PC or workstation 23 to determine the correct postage amount. In accord with the invention, the post production print processing application 27 obtains a digital token for use in applying postage from the postage application 29 and a PSD 31. The application 27 controls subsequent document processing, in part based on the token, in order to produce a finished mail piece including the document and bearing an indicia derived from the digital token.

The indicias may be produced in-band or out-of-band. 'In-band' means that indicias are printed on the documents, e.g. for viewing and cancellation through windows of the envelopes. 'Out-of-band' means that the indicias are separated out from the document print files and codes are supplied in a separate control file to the inserter. The inserter in turn prints the indicias on the corresponding envelopes and inserts the printed documents therein.

In the embodiment of FIG. 1, the system provides in-band indicia printing. The post production print processing application 27 uses a token to modify the print image of each document to contain a postage indicia derived from the corresponding digital token.

Figure 3:
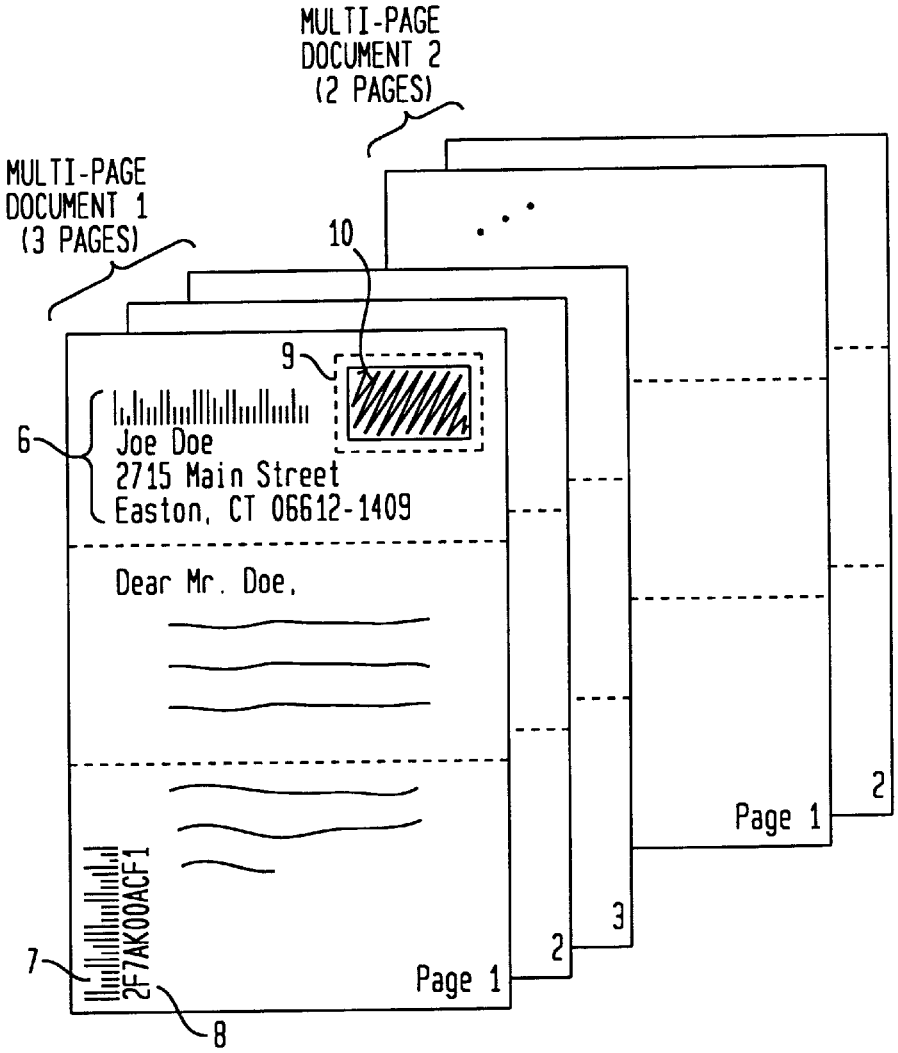
FIG. 3 illustrates a plurality of printed documents, at least one of which includes a postal indicia, printed by the system of FIG. 1.
Figure 4:
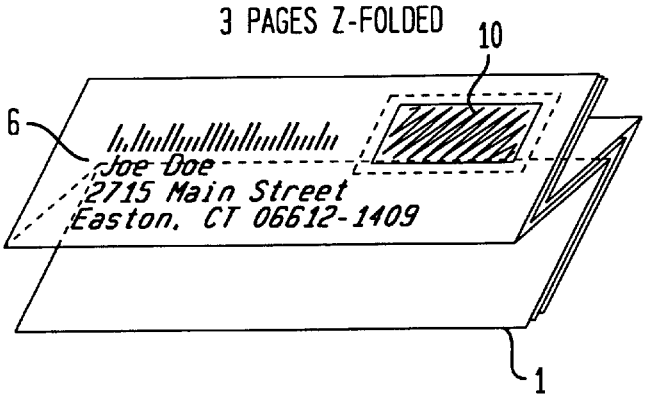
FIG. 4 illustrates the first document from FIG. 3 folded for insertion in an envelope.
Figure 5:
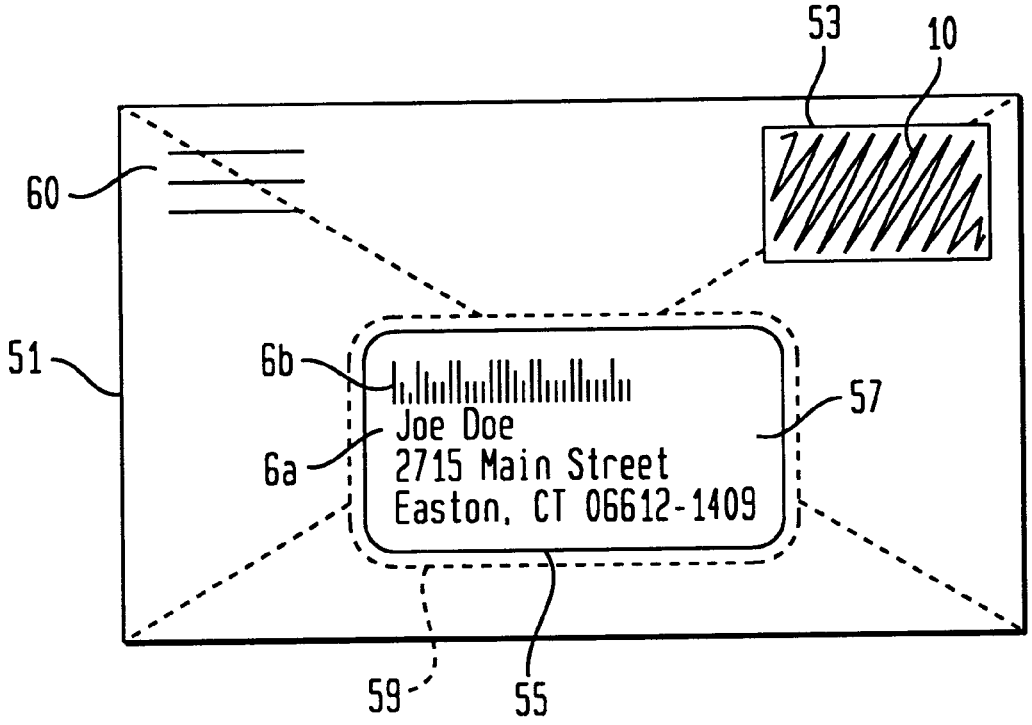
FIG. 5 illustrates a windowed envelope containing the document of FIG. 4 with the indicia visible through one of the windows.

FIGS. 3 to 5 illustrate the elements of a mail piece produced and finished by the system of FIGS. 1 and 2. FIG. 3 illustrates two documents in the print stream produced by the laser printer(s) 35. In the illustrated example, the first document 1 includes three pages, and the second document 2 contains two pages. The first page of each document contains a variety of information used in processing the document by the system and in subsequent processing of the mail piece by postal authorities.

The first page of each document, such as shown on document 1, includes destination address information in a field 6. The address field 6 includes the name and street address of the intended recipient. One feature of the invention is that the post production print processing application 27 extracts this information from the print image of the document contained in the print file 21 and performs one or more operations on the address. The application can check the address against a database of valid postal addresses and correct the address, for example as described in commonly assigned U.S. Pat. No. 5,454,038 to Cordery et al. The post production print processing application can also add digits to the zip code to produce a zip+4 code or an 11-digit zip code. The address field 6 may also contain a postal routing bar code, in standard format specified by the postal authority. If so, the bar code may be an element of the image from print file 21, but preferably the application 27 analyzes the correct address information and adds the bar code to the image in the resultant modified print file 33. The application 27 may also move the address information in field 6 so as to appear in a desired location on the page, e.g. to be visible through a window at a known location on envelope.

The first page of the document may also carry certain control information used by the finishing equipment 39. In the illustrated example, the first page 1 includes a bar code 7 and a numeric code 8 in the lower left corner.

The first page of the printed document includes a region 9 for the indicia, for example in the upper right corner of the page. In the drawing, the printed indicia 10 appears within the region 9 on the first page of document 1. The indicia may take any form specified by the controlling postal authority. As discussed later, the post production print processing application places the print image for the indicia in the document image so that the region 9 on which the indicia 10 appears in the printed document corresponds to a window of the envelope that will receive the printed document 1.

One function of the finishing equipment 39 may be to fold printed documents 37, as necessary for insertion into envelopes. FIG. 4 shows the first document 1 in the stream folded in a Z-fold manner, for example for insertion into a standard #10 envelope. As shown, the address information 6 and the indicia 10 appear on the top leaf of the folded document.

FIG. 5 shows an envelope 51 containing the first document illustrated in FIGS. 3 and 4. The envelope 51 has two windows, 53 and 55. The indicia 10 aligns with the window 53, in the upper right corner of the envelope 51, so that the indicia is visible. The envelope 51 may include a transparent covering for the window 53, but preferably, the window 53 is an open window, with no covering. The open window enables the postal authority to physically access the indicia for cancellation.

The address field on the first page of the document aligns with the window 55, so that when the document is inserted in the envelope, the textual portion 6*a* of the address and the bar code routing information 6*b* are visible through the window 55. The window 55 may be an open window, but in the illustrated embodiment, the window 55 includes a transparent covering 57 to protect the document within. For example, a transparent sheet material slightly larger than the window opening may be glued to the interior of the envelope as shown by the dotted line at 59, in such a position as to cover and close the window opening. The address information 6*a*, 6*b* is visible and scannable through the window and the transparent cover.

In the example shown in FIG. 5, the envelope 51 also includes a region 60 in the upper left corner which may carry preprinted return address information.

In the embodiment of FIG. 1, the post production print processing application 27 merges the indicia image with the document print image obtained from the batch print file 21. The resulting print image for the document is included in the modified print file 33 which the application sends to the high volume document printer 35. The printer uses the modified images to print a series of documents as shown in FIG. 3.

As currently described in proposed specification by the U.S. Postal Service, the electronically printed information based indicia includes certain human readable information such as the date and the postage amount. The indicia also includes a two-dimensional bar code. The bar code contains in-the clear information such as PSD identification, postage value and various routing information. The bar code also includes a digital signature formed by encryption of certain data specified by the U.S.P.S. The data used as the input to the encryption process for the digital signature includes device ID information, the ascending and descending register values, a special purpose field, the postage value, licensing zip code, the date and the amount of postage. The digital token supplied by the PSD includes at least the character information necessary for printing these elements of the indicia.

Some postal indicias also include graphical information, such as emblems, stylized slogans, advertising and the like. The graphical information may be supplied with the digital token, but this requires a large bandwidth to carry the indicia information through various links in the system. Preferably, the last processor in flow of the indicia information before actual printing of the indicia stores a digital representation of the graphical portion of the indicia. That element combines the information from the token with the graphical information to produce the signal to drive the actual print element to produce the indicia on the respective mail piece. For example, if an envelope printer is used as in a later discussed embodiment, the processing element in the printer may retrieve the graphical information from local memory and produce the indicia in response to the tokens.

In the embodiment of FIG. 1, the indicias are merged into the print images of the documents by the post production print processing application 27. For this purpose, the PC 23 stores the graphical portion of the indicia in one of its memories or storage devices. The application 27 retrieves the graphic from memory and combines the data from the token for one mail piece with the graphic, to form a bit map type print image of the indicia for that mail piece. The post production print processing application 27 merges the indicia print image with the cover page of the print image for the document, as part of its processing to form the modified print file. When the high volume laser printer 35 receives the modified print file, it prints the mail piece document with all of the changes made by the application 27, including the added image of the indicia.

Figure 6A:
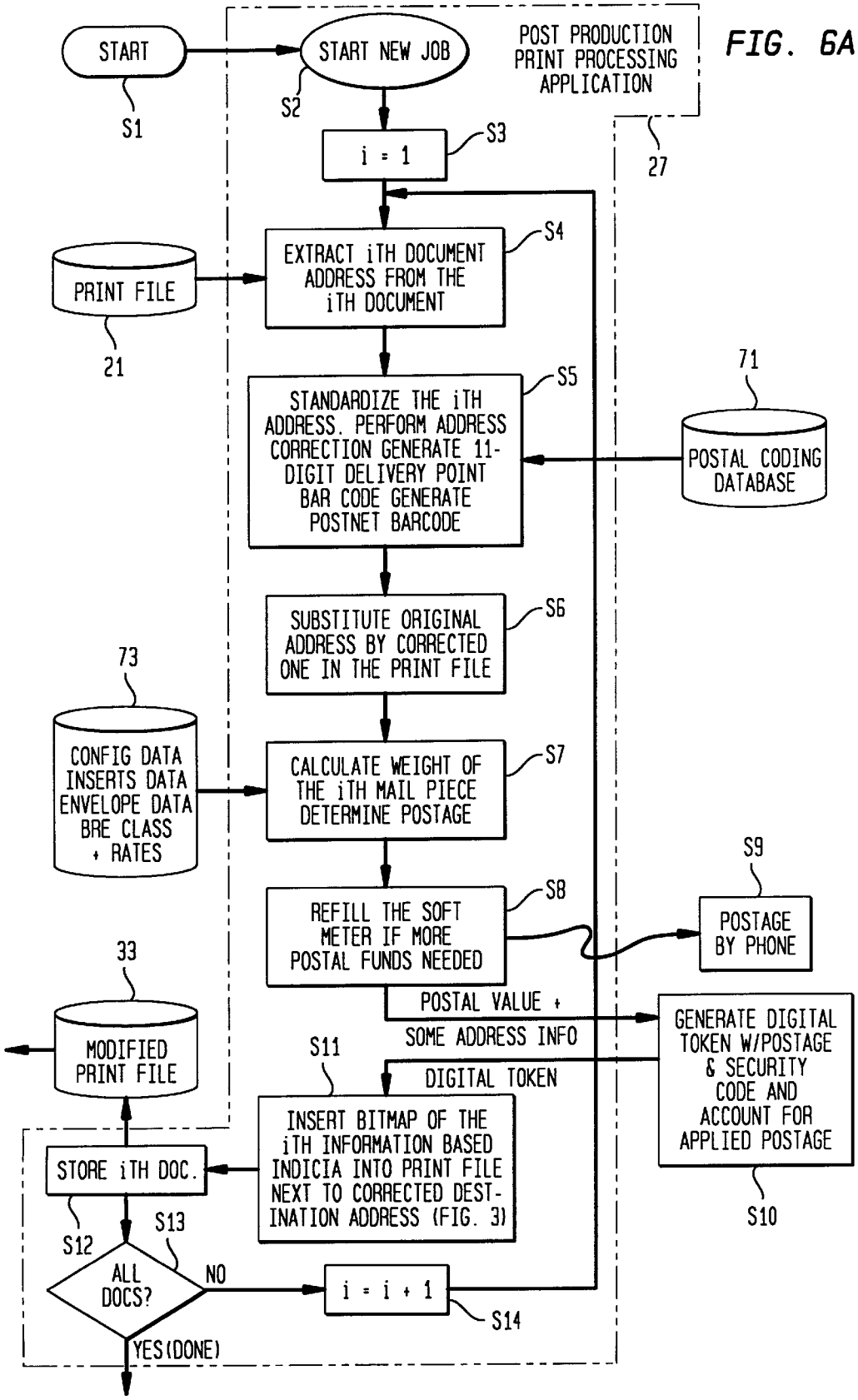
FIGS. 6A and 6B together form a simplified flow chart representing the processing in the system of FIG. 1, to produce mail pieces of the type illustrated in FIG. 5.
Figure 6B:
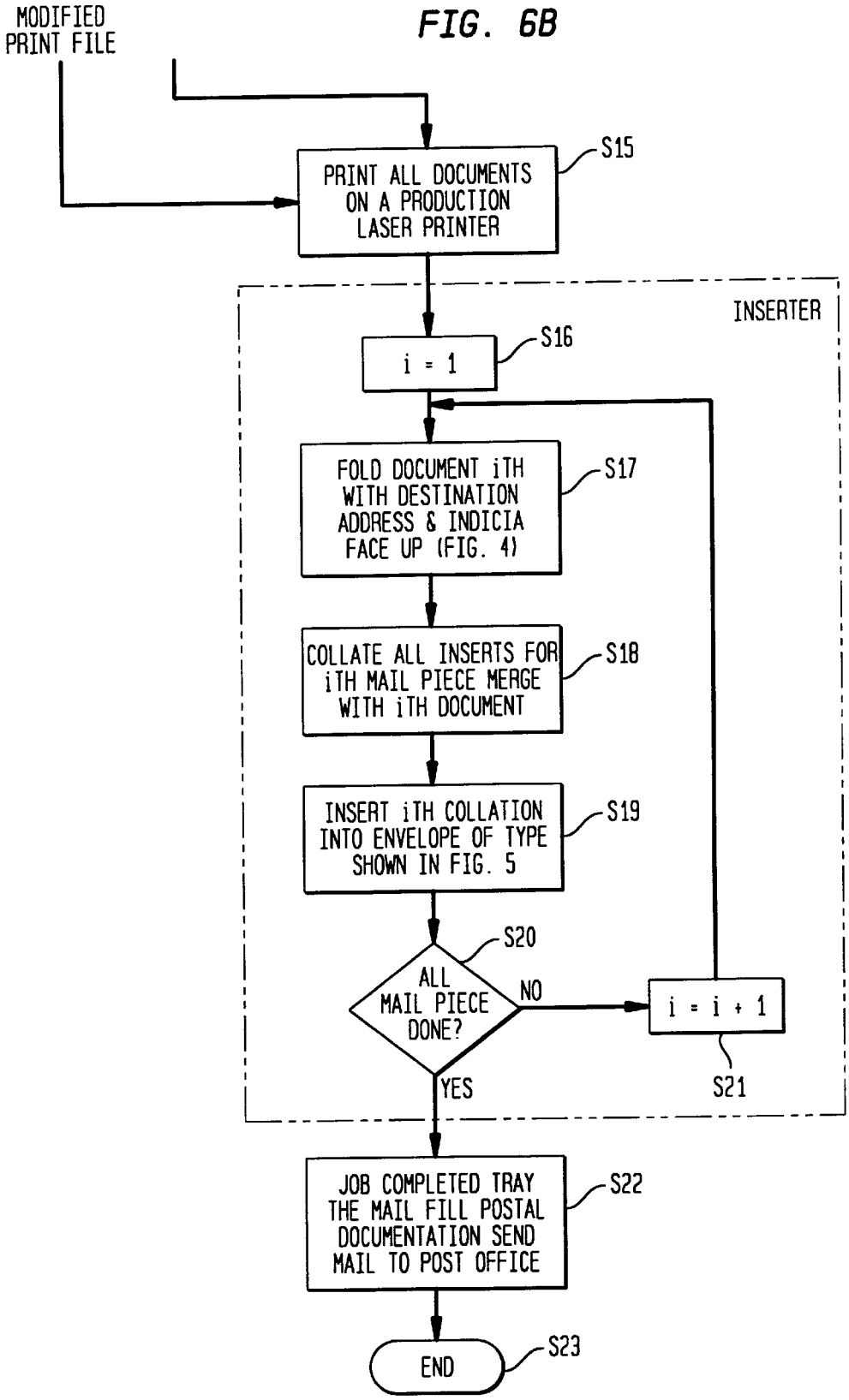

FIGS. 6A and 6B together provide a simplified flow diagram of the process steps performed by the system of FIG. 1 to produce mail pieces of the type shown in FIG. 5. As shown in FIG. 6A, operation of the processing starts (S1) when one of the vertical processing applications 19 supplies a print file 21 to the post production print processing application 27. In response, the application 27 starts a new batch processing job (S2). The post production print processing application 27 processes each document image in the file 21 in turn, until all have been processed. The application maintains a document counter i throughout the processing of the batch file, and after start-up, the application program 27 sets the value of i=1 (S3).

In step S4, the post production print processing application 27 extracts the ith document from the print file 21 and obtains the destination address therefrom. In the first pass, the value i=1, therefore the post production print processing application 27 extracts the print image and address for the first document in the file.

In the next step (S5), the post production print processing application 27 standardizes the address obtained from the ith document, in this case, the first document address. For this purpose, the application 27 accesses a postal coding database 71, to determine the accuracy of the address. If there is an error in the address obtained from the document image, the post production print processing application 27 obtains the correct address from the database 71 and uses that address to obtain certain related postal routing information, such as the zip+4 or 11-digit zip code, and to generate a delivery point bar code or generic POSTNET bar code corresponding to the correct address. The application 27 then modifies the print image of the document by replacing the original address contained in the image with a modified or corrected address image (S6). The corrected address image will have the correct address, the full zip code and one or more corresponding bar codes. The post production processing application may manipulate the print image in other ways relating to the address, for example to move the address so as to appear at a specific location on the document when printed (e.g. to align with and appear in an envelope window as in FIG. 5).

In step S7, the post production print processing application 27 calculates the weight of the ith mail piece. For this purpose, the application examines the print image to determine the number of page breaks and thus the number of pages that the printed document will contain. The application also examines configuration information from a related file in database 73, for example to identify any preprinted inserts that may be added during document finishing and to obtain data regarding the envelope. The post production print processing application 27 calculates the total weight of the finished mail piece based on the number of pages of the printed document, the number of pages of inserts and the known weight of the envelope that will carry the document.

The post production print processing application also identifies the class of the mail pieces contained in this job from the database 73. Based on the weight and class, the application can access the rate table corresponding to the mail class and determine the postage necessary for the ith mail piece.

In step S8, the post production print processing application 27 checks to determine if the necessary postage is available. For example if the meter functionality is internal, i.e. in software, the application checks the internally maintained descending register value and compares that value to the postage needed for the ith document. If the meter functionality resides on an external device, such as the PSD 31 in FIG. 1, the application 27 may query the meter to make this determination. If the necessary postage is not available, a refill operation is initiated. In the example of FIGS. 1 and 2, the application triggers an operation to contact a data center and recharge the postage in the PSD by communication through the telephone network (S9).

If the meter stores sufficient postage or has been recharged, processing flows from step S8 to step S10. In step S10, the application 27 supplies the postage and certain address information to the meter, for example through the meter application 29 to a PSD 31 in the system of FIGS. 1 and 2. Using the postage and the address information, the meter generates a digital token for use in printing a postage indicia in accord with the appropriate postal specifications. The meter supplies the digital signals representing the token back through the appropriate hardware and software components to the post production print processing application 27. At the same time, the meter performs the various functions to account for the postage represented in the token as postage applied to a mail piece.

At step S11, in response to the digital token, the post production print processing application 27 generates a bit map image of a digital information-based indicia. This bit map image includes the postage amount and the date, as in-the-clear text. The bit map image also includes at least some encrypted information for validating the postage imprint. In accord with proposed specifications by the U.S.P.S., the image will include a two-dimensional bar code containing some in-the-clear information and a security code derived from the postage value, address information, etc. The post production print processing application 27 may also add graphical information to the bit map image of the indicia. The post production print processing application 27 inserts the bit map of the complete indicia into the print image of the document, for example so as to appear at the location on the first document page illustrated in FIG. 3.

After step S11, assuming all other manipulations of the document print image are complete, the post production print processing application 27 stores the modified print image for the ith document in the modified print file 33 (S12). In step S13, the application 27 then checks to determine if it has completed processing of the print images for all documents for this job (all images in the current batch print file 21). If not, the job is not done. The post production print processing application 27 therefore increments the value of i by 1 (S14) and loops processing back to step S4, so that the application processes the next document image from the file 21. In this manner, the process steps S4 to S13 repeat until the application 27 completes processing of all documents in the current job. Although not shown in this flow chart, the application processing for each document in the file 21 also creates a control record for use in finishing the document, and the application accumulates those control records in an MRDF file 47.

When the post production print processing application 27 has processed all of the documents in the current batch job, the overall system flow branches from step S13 to step S15 (FIG. 6B). At this point, the application 27 supplies a print command to the laser printer(s) 35 together with the modified print file 33, and the printer(s) use the modified images to print all of the documents. At the same time, the post production print processing application supplies the MRDF file 47 to the OMS 49, and the OMS provides the control codes from the MRDF file to the various elements of the finishing equipment 39.

The laser printer(s) 35 print the documents in a stream as shown in FIG. 3, i.e. with the first page of each document bearing the address information 6 and the printed indicia 10. The laser printer(s) 35 supply the printed documents to the finishing equipment 39, in this example to an inserter. The inserter maintains a document counter i throughout the processing of the batch of documents, and as it begins to receive the documents from the printer(s) 35, the inserter sets the value of i to 1 (S16).

For purposes of this example, assume that the documents are to be folded and inserted into envelopes, in the manner illustrated in FIGS. 4 and 5. At step S17, the inserter folds the ith document in such a manner that the leaf of the first page bearing the address and the indicia are face up. The inserter collates any preprinted inserts for the ith document and merges the collated inserts with the document (S18). The collated ith document is inserted into a windowed envelope (S19), to produce a finished mail piece of the type shown in FIG. 5, with the address information and the indicia visible through the windows of the envelope.

After step S19, assuming all finishing operations of the ith document are complete, the inserter outputs the finished mail piece. In step S20, the inserter then checks to determine if it has completed processing of all of the documents in this job. If not, the job is not done. The inserter therefore increments the value of i by 1 (S21) and loops processing back to step S17, so that the inserter processes the next document. In this manner, the process steps S17 to S20 repeat until the inserter completes processing of all documents in the current job.

When the inserter completes finishing of all of the documents in the current batch job, the overall system flow branches from step S20 to step S22. At this point, the finished mail pieces are accumulated in a tray, any postal documentation associated with the mail batch is filled out, and the mail is sent to the post office. Processing of the batch of mail pieces therefore is complete and ends at step S23.

Figure 7:
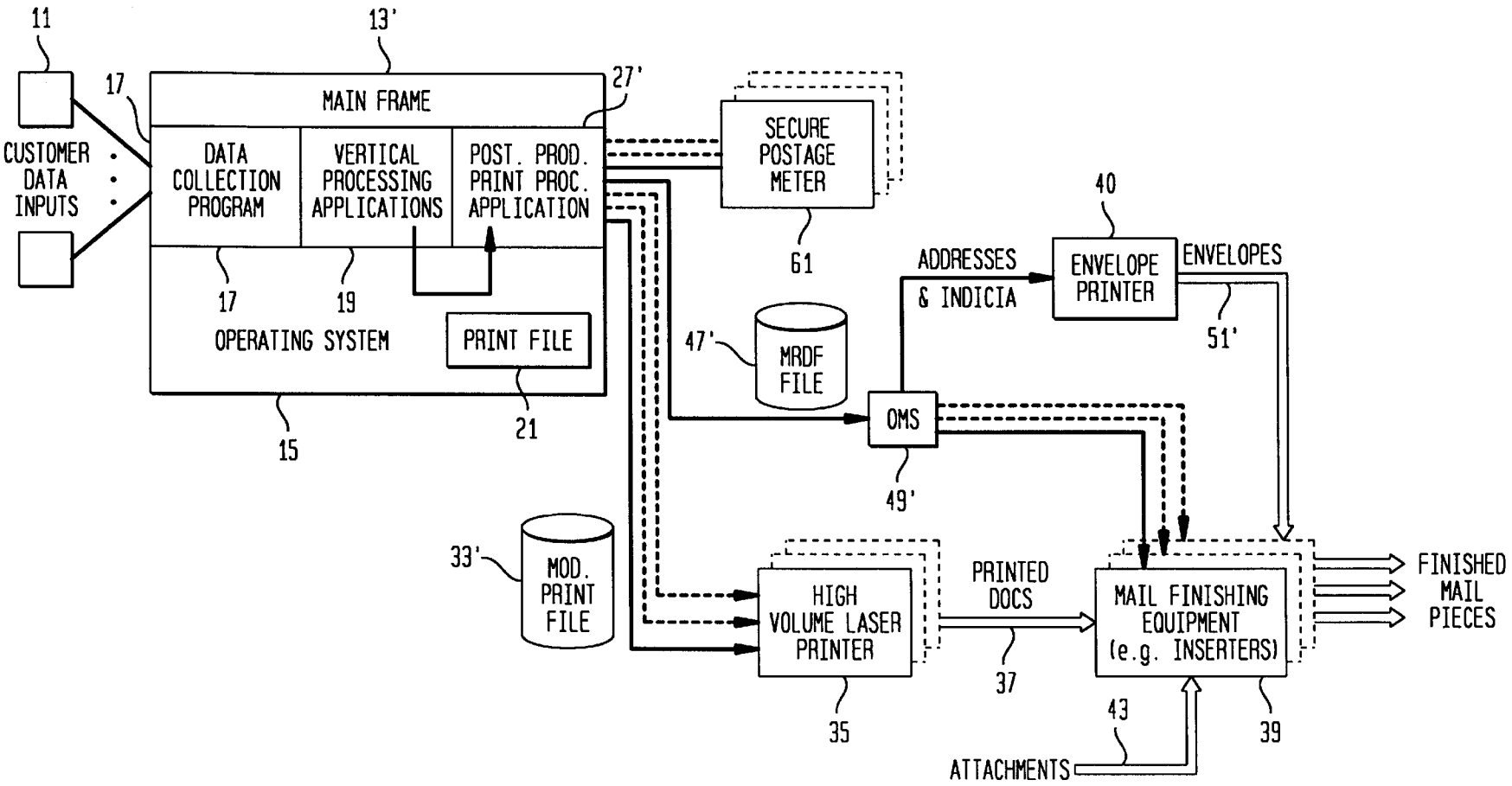
FIG. 7 is a simplified block diagram of a second embodiment of a high volume mailing system operating in accord with the principles of the present invention.

FIG. 7 illustrates another embodiment of a mass mail processing system operating in accord with the present invention. The system shown in this drawing is generally similar to that of FIG. 1, and like reference numerals are used where appropriate to signify like elements. However, there are two differences of particular note. In the system of FIG. 7, the post production print processing application 27' runs as another application on the main frame computer 13'. Also, the mail finishing equipment in the system shown in FIG. 7 includes at least one envelope printer 40, and in at least some instances, the printer 40 applies the indicias to the envelopes 51'.

As in the earlier embodiment the system shown in FIG. 7 includes data input sources 11 enabling input of various customer data and related control information into a main frame computer 13', which again may be an IBM/370. The main frame computer 13' runs an operating system 15, and a number of applications programs run on top of that operating system program. The application programs include a data collection program 17 for receiving the input data from the devices 11. One or more vertical processing applications 19 process the input data from collection program 17 and various stored information, to produce batch mailing files for printing.

Each of the print files 21 contain print images for multiple documents, exactly as in the earlier embodiment. In the system of FIG. 7, however, an application 19 generates a print file 21 and supplies that file through the internal structure of the main frame to the post production print processing application 27', under control of the main frame operating system 15.

The post production print processing application 27' manipulates each document print image in the print file 21 in accord with the user's requirements, for example to correct addresses, add bar codes, sort documents and the like as outlined above. In accord with the invention, the post production print processing application 27' also analyzes each document print image in the print file 21 to derive postage processing related information. For example, the application 27' obtains the destination address from each document, and counts the number of pages in each document. Based on the derived information and a selected mail class, the application 27' calculates the appropriate postage for each document.

In the embodiment of FIG. 7, the post production print processing application 27' directly interacts with one or more secure postage meters 61. The meter(s) 61 may be similar to the PSD used in the earlier embodiment or any other type of postage meter. In one example, the secure postage meter 61 may actually be a secure software module running within the main frame computer system 13', either as another application or as a module within the post production processing application. The secure meter 61 may be a conventional postage meter operating in a mode to supply postage tokens through a connection port to another device, such as the PostPerfect Meter manufactured by Pitney Bowes operating in its remote postage mode.

If the meter 61 is separate from the mainframe 13', these two components may communicate via some type of direct connection or a local data network, or these two components may be located at widely separated sights and exchange information via a communication network. For example, the secure postage meter 61 for this mailer may be implemented in software in a remote data center.

In any case, the post production print processing application 27' will provide a message to the meter 61 requesting the calculated postage for a given document. The message preferably includes some information regarding the mail piece that will contain the document, such as source and/or destination zip or address information. For each document, the postage meter 61 returns a digital token, of the type discussed with regard to the earlier embodiment, for use in printing a postal indicia on the mail piece that will include the document.

As in the earlier embodiment, the post production print processing application produces a modified print file 33' and an MRDF file 47'. The print images in the modified print file 33' may contain indicia, as discussed above, but for purposes of this discussion now, assume that the images in the modified print file 33' do not include the indicia information. In such an implementation, the post production print processing application 27' will include the token or information derived from the token in the control record for the respective document in the MRDF file 47'.

The main frame 13' transmits the MRDF file 47' from the application 27' over an appropriate connection to the OMS 49'. The OMS manages mail finishing equipment 39, such as one or more inserters. In this embodiment, the OMS 49' also provides control signals from records in the MRDF file 47' to one or more envelope printers 40 (only one of which is shown). The OMS divides the control records in the MRDF file 47' into appropriate segments and supplies the segments to the relevant equipment 39, 40. For example, the OMS supplies address and/or indicia related information to the envelope printer 40 and sends control codes to the inserter(s) 39 to fold and insert documents 37 from the printer(s) 35 into the envelopes 51' received from the printer 40.

In the embodiment of FIG. 7, the envelope printer 40 feeds printed envelopes 51' to one or more inserters. Alternatively, the envelope printer could be downstream from the inserters and print addresses and/or indicia on the completed mail pieces output from the inserter(s).

Figure 8:
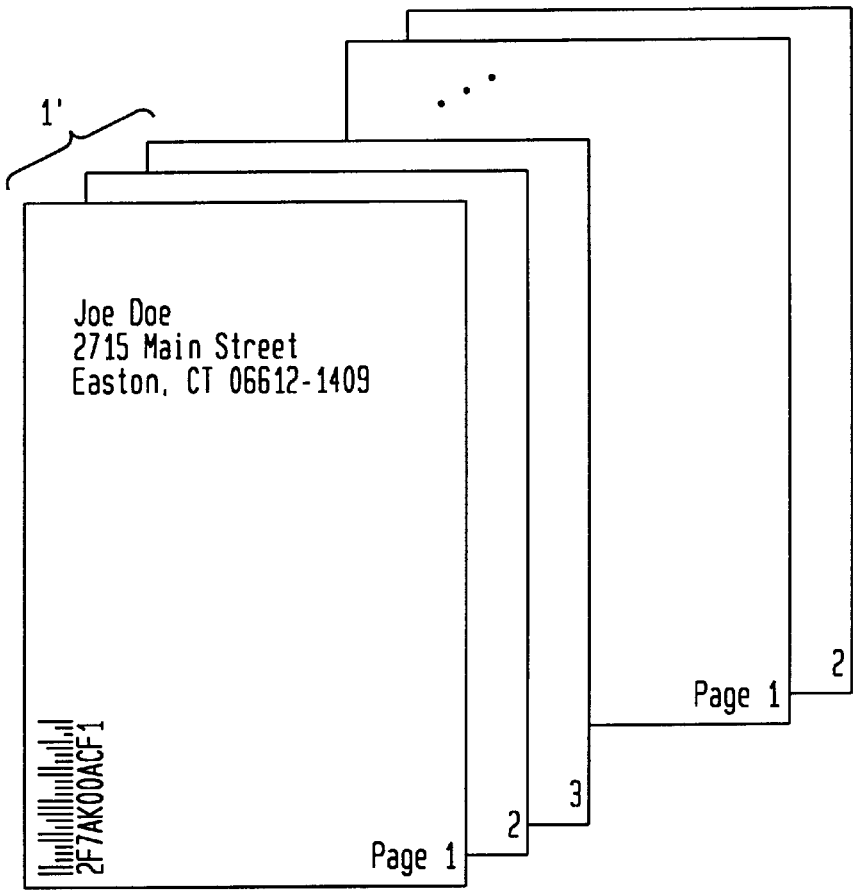
FIG. 8 illustrates a plurality of documents printed by the system of FIG. 7.
Figure 9:
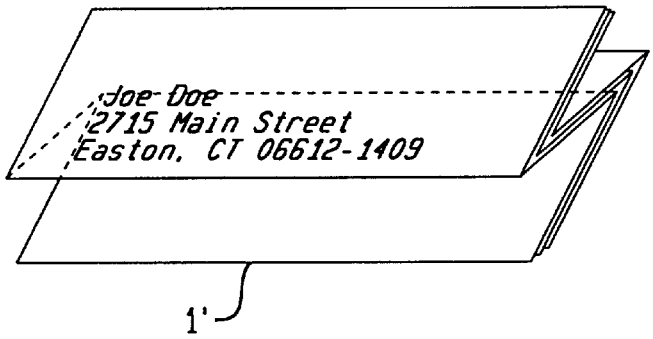
FIG. 9 illustrates the first document from FIG. 8 folded for insertion in an envelope.

FIGS. 8 and 9 illustrate documents produced by the system of FIG. 7, and FIGS. 10A to 10C depict various finished mail pieces that the system may produce. FIG. 8 illustrates two documents in the print stream produced by the laser printer(s) 35. In the illustrated example, the first document 1' includes three pages, and the second document contains two pages. The first page of each document typically contains an address, and the post production print processing application may move the address, correct the address and add sorting and routing codes as in the embodiment of FIG. 3. The application may add an indicia as discussed above, but this feature is not shown in FIG. 8.

The finishing equipment 39 may fold printed documents 37, as necessary for insertion into envelopes, and FIG. 9 shows the first document 1' in the stream folded in a Z-fold manner, for example for insertion into a standard #10 envelope. As shown, the address information 6 appears on the top leaf of the folded document.

The first page of each document, such as shown on document 1, includes destination address information. The address field includes the name and street address of the intended recipient. One feature of the invention is that the post production print processing application 27 extracts this information from the print image of the document contained in the print file 21 and performs one or more operations on the address. The application preferably checks the address against a database of valid postal addresses and corrects the address, if necessary. The post production print processing application can also add digits to the zip code to produce a zip+4 code or an 11-digit zip code, and analyze the correct address information and add a postal bar code to the image in the resultant modified print file 33'. The application 27 may also move the address information in field 6 so as to appear in a desired location on the page, e.g. to be visible through a window at a known location on envelope.

The first page of the document may also carry certain control information used by the finishing equipment 39. In the illustrated example, the first page 1 includes a bar code 7 and a numeric code 8, in the lower left corner, added to the print image by the post production print processing application 27'.

Figure 10A:
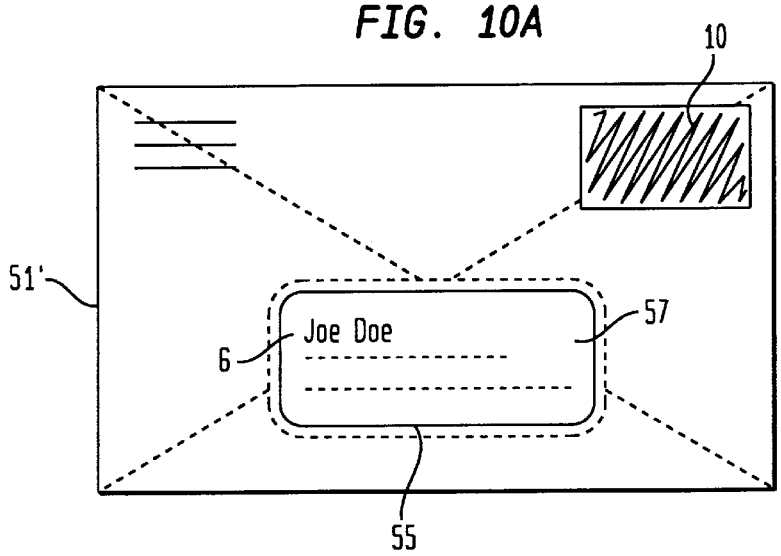
FIG. 10A illustrates the document of FIG. 9 inserted into a windowed envelope with the address visible through one of the windows but with the indicia printed on the envelope.

FIG. 10A shows an envelope 51' containing the first document illustrated in FIGS. 8 and 9. In this embodiment, the envelope 51' has only one window 55 having a transparent covering 57. Here, the indicia 10 appears in the upper right hand corner of the envelope 51'.

The modified document image from the modified print file 33' causes the laser printer to print the first page of the document 1 with the address information in the correct position to align with the window 55 when the inserter places the document in the envelope 51'. The corresponding control record from the MRDF file 47' causes the envelope printer 40 to generate and print an indicia 10, containing the correct postage and other information relating to the specific mail piece, in the upper right hand corner of the envelope 51' that will eventually contain the document 1. When the inserter places the document in the corresponding envelope, the finished mail piece will appear essentially as illustrated in FIG. 10A, with the address visible through the window and the appropriate indicia printed on the envelope.

Figure 10B:
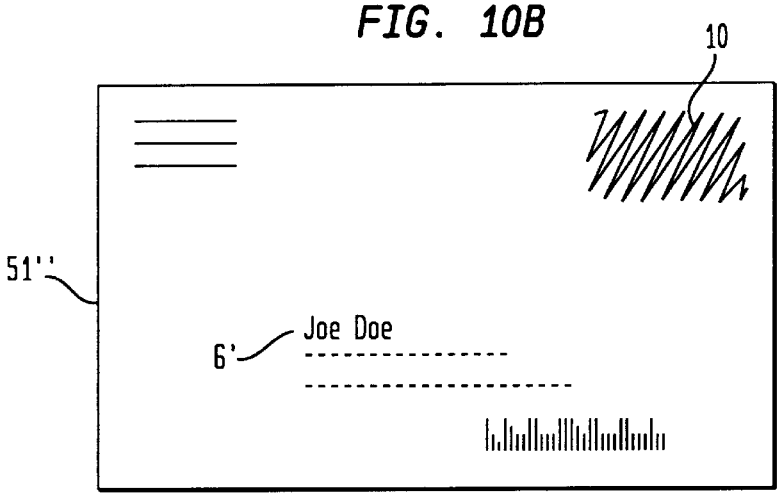
FIG. 10B illustrates an envelope bearing a printed address and indicia.

FIG. 10B illustrates an alternate version of the finished mail piece. Here the envelope 51" includes no windows. The control record for this mail piece contained in the MRDF file 47' specifies the address as well as the information needed for printing the indicia. In response, the printer 40 prints the indicia 10 and the address information 6' on the face of the envelope 51". The inserter places the document and corresponding inserts in the envelope to finish the mail piece.

As another alternative, the envelope 51" may have a window 53 for the indicia 10. The indicia 10 printed on the document 1 (FIG. 3) aligns with the window 53, in the upper right corner of the envelope 51, so that the indicia is visible. The envelope 51 may include a transparent covering for the window 53, but preferably, the window 53 is an open window, with no covering. The open window enables the postal authority to physically access the indicia for cancellation.

Figure 10C:
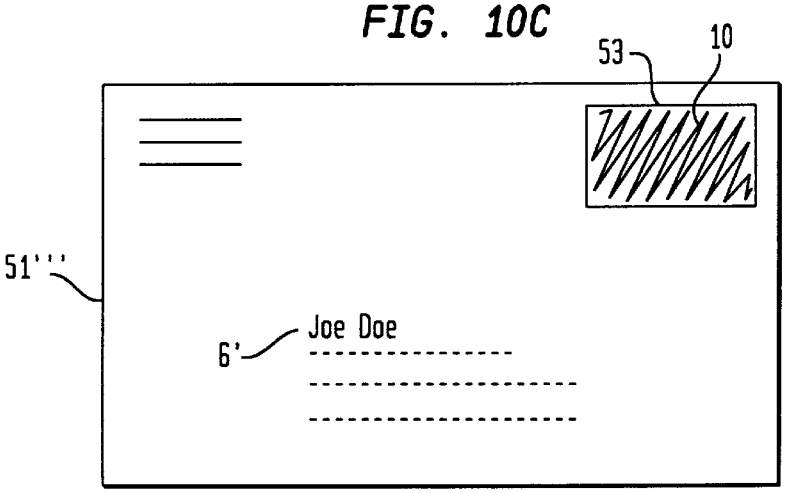
FIG. 10C illustrates an envelope with a printed address and with an indicia printed on the document visible through a window, which also may be produced by the system of FIG. 7.

In the embodiment of FIG. 10C, the post production print processing application 27' would include the indicia image in the print image in the modified print file 33' so that the laser printer 35 would print the document in such a manner that the indicia will align with the window 53 when the folded document is placed in the envelope 51'". This document print operation is the same as that discussed above with regard to FIGS. 1 and 3. In the embodiment of FIG. 10C, however, the MRDF file 47' provides address information, and the envelope printer 40 prints the destination address 6' on the envelope.

Figure 11A:
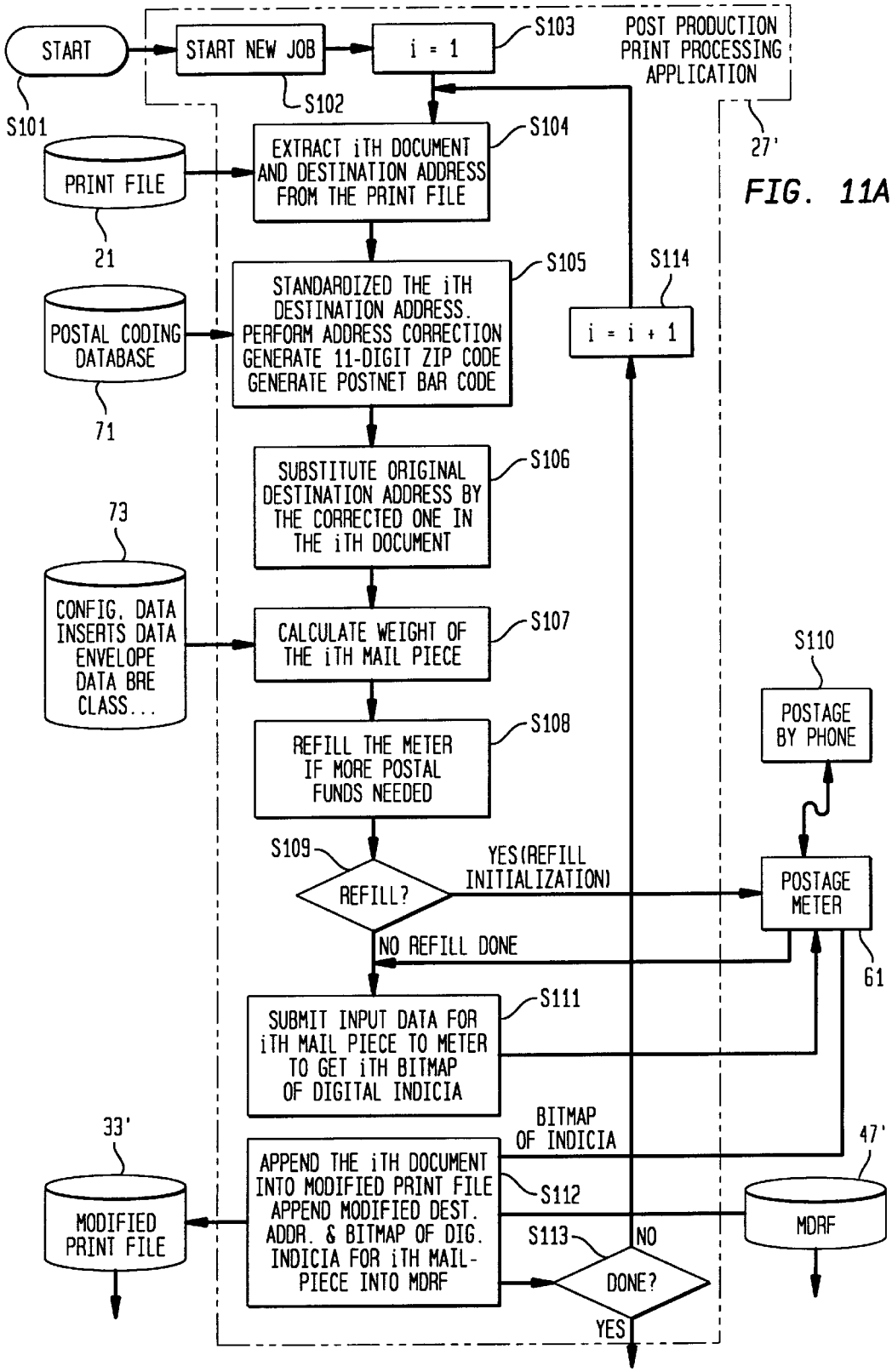
FIGS. 11A and 11B together form a simplified flow chart representing the processing in the system of FIG. 7 to produce mail pieces of the type shown in FIG. 10B.
Figure 11B:
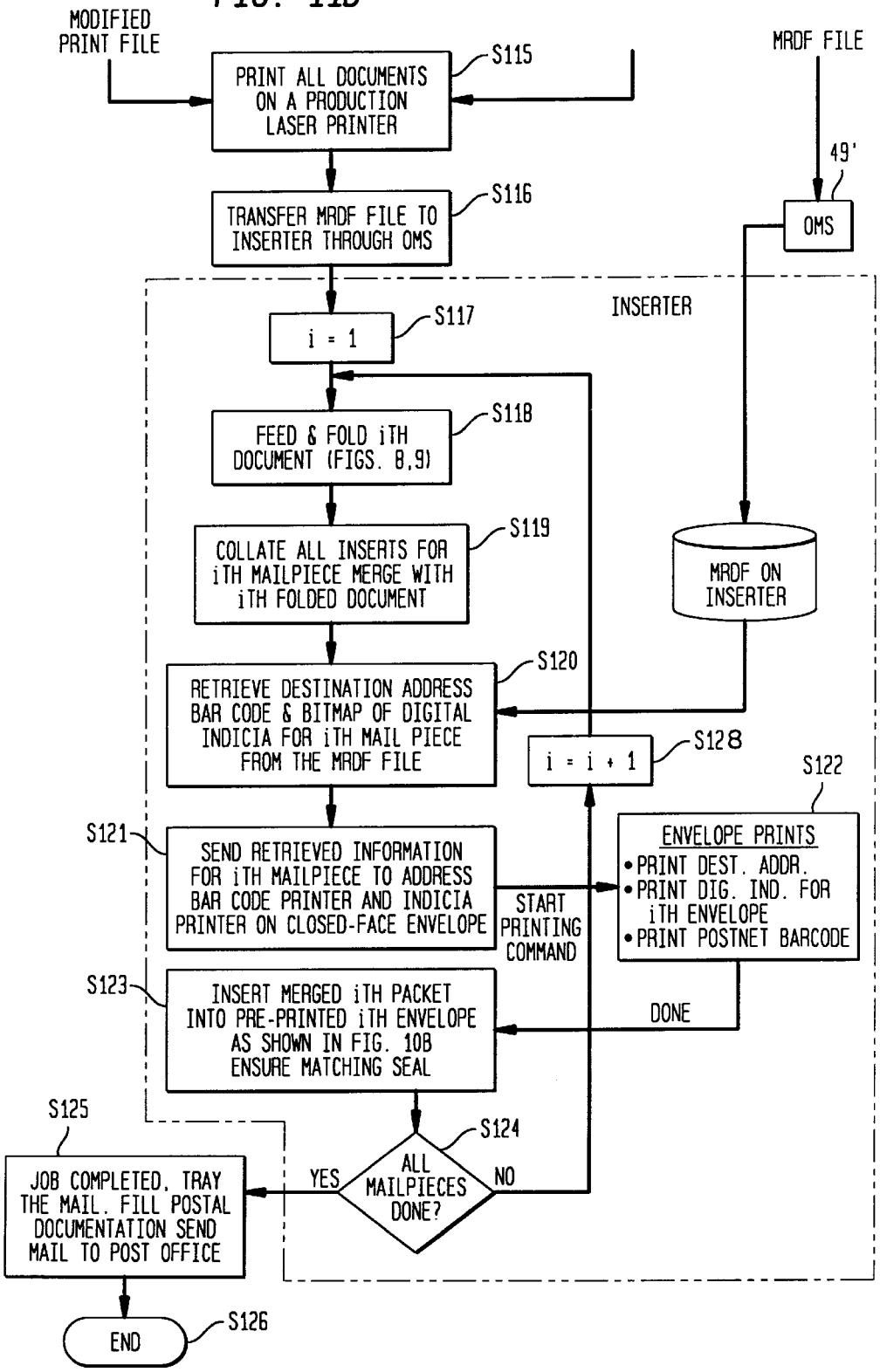

FIGS. 11A and 11B together provide a simplified flow diagram of the process steps performed by the system of FIG. 7 to produce mail pieces. Assume for this discussion that the mail pieces use a closed envelope bearing an address, with a POSTNET bar code as well as a printed indicia, as shown for example in FIG. 10B. As shown in FIG. 11A, operation of the processing starts (S101) when one of the vertical processing applications 19 supplies a print file 21 to the post production print processing application 27'. In response, the application 27' starts a new batch processing job (S102). The post production print processing application 27' processes each document image in the file 21 in turn, until all have been processed. The application maintains a document counter i throughout the processing of the batch file, and after start-up, the application program 27 sets the value of i=1 (S103).

In step S104, the post production print processing application 27' extracts the ith document from the print file 21 and obtains the destination address therefrom. In the first pass, the value i=1, therefore the post production print processing application 27' extracts the print image and address for the first document in the file.

In the next step (S105), the post production print processing application 27' standardizes the address obtained from the ith document, in this case, the first document address. For this purpose, the application 27' accesses a postal coding database 71, to determine the accuracy of the address. If there is an error in the address obtained from the document image, the post production print processing application 27' obtains the correct address from the database 71 and uses that address to obtain certain related postal routing information, such as the zip+4 or 11-digit zip code, and to generate a POSTNET bar code corresponding to the correct address. The application 27 then modifies the print image of the document by replacing the original address contained in the image with a modified or corrected address image (S106). The corrected address image will have the correct address, the full zip code and one or more corresponding postal bar codes.

In step S107, the post production print processing application 27' calculates the weight of the ith mail piece, and using information from the database 73, determines the appropriate postage in the manner described above with regard to step S7 in FIG. 6A.

In step S108, the post production print processing application 27' checks to determine if the necessary postage is available. In the system of FIG. 7, the meter functionality resides in an external meter 61. Thus, the application 27' queries the meter 61 to make this determination. If the necessary postage is not available, a refill operation is needed, and processing branches at step S109 to instruct the meter 61 to initiate its refill operation. In step S110, the meter 61 obtains additional postage, e.g. by communication via the telephone network.

If the meter 61 stores sufficient postage or has been recharged, then processing branches to step S111. In step S1, the application 27' inputs the postage data for the ith document to the meter 61. As in the earlier example, the input information for the ith mail piece includes the calculated postage value and certain mail piece related information. The meter 61 uses the input information to generate a digital token or a bit map of the information based indicia, containing the postage information and the security code for the ith document as discussed above.

At step S111, in response to the signal from the meter, the post production print processing application 27' appends the modified address information for the ith document together with a bit map image of the indicia for that document to the control record for that document in the MRDF file 47'.

Assuming all other manipulations of the document print image are complete, the application 27' also appends the modified document image for the ith document to the modified print file 33' (S112).

In step S113, the application 27' checks to determine if it has completed processing of the print images for all documents for this job (all images in the current batch print file 21). If not, the job is not done. The post production print processing application 27' therefore increments the value of i by 1 (S114) and loops processing back to step S104, so that the application processes the next document image from the file 21. In this manner, the process steps S104 to S113 repeat until the application 27' completes processing of all documents in the current job. The complete processing results in a modified print file 33' and a complete MRDF file 47' for the batch of documents.

When the post production print processing application 27' has processed all of the documents in the current batch job, the overall system flow branches from step S113 to step S115 (FIG. 11B). At this point, the application 27' supplies a print command to the laser printer(s) 35 together with the modified print file 33', and the printer(s) use the modified images to print all of the documents (S115). The post production print processing application 27' also supplies the MRDF file 47' to the OMS 49' (S116), and the OMS provides the control codes from the MRDF file to the various elements of the finishing equipment 39.

The laser printer(s) 35 print the documents in a stream as shown in FIG. 8. The laser printer(s) 35 supply the printed documents to the finishing equipment 39, in this example to an inserter. The inserter maintains a document counter i throughout the processing of the batch of documents, and as it begins to receive the documents from the printer(s) 35, the inserter sets the value of i=1 (S117).

For purposes of this example, assume that the documents are to be folded and inserted into envelopes 51", which have no windows (FIG. 10B). At step S118, the inserter feeds and folds the ith printed document, then the inserter collates any preprinted inserts for the ith document and merges the collated inserts with the document (S119).

The destination address for the ith document as well as the bit map for the associated indicia are retrieved from the control record for the ith mail piece contained in the MRDF file 47' (S120). The retrieved information is sent to the envelope printer 40 (S121), and that printer receives a command to start printing. In response, the printer 40 prints the address and the indicia for the ith document on the face of the ith closed envelope 51" (S122). Next, the collated ith document is inserted into the ith envelope, i.e. into the envelope printed with the address and indicia associated with the ith document (S123)), to produce a finished mail piece of the type shown in FIG. 10B.

After step S123, assuming all finishing operations of the ith document are complete, the inserter outputs the finished mail piece. In step S124, the inserter then checks to determine if it has completed processing of all of the documents in this job. If not, the job is not done. The inserter therefore increments the value of i by 1 (S128) and loops processing back to step S118, so that the inserter processes the next document. In this manner, the process steps S118 to S124 repeat until the inserter is done processing of all documents in the current job.

When the inserter completes finishing of all of the documents in the current batch job, the overall system flow branches from step S124 to step S125. At this point, the finished mail pieces are accumulated in a tray, any postal documentation associated with the mail batch is filled out, and the mail is sent to the post office. Processing of the batch of mail pieces therefore is complete and ends at step S126.

While the foregoing has described what are considered to be preferred embodiments of the invention, it is understood that various modifications may be made therein and that the invention may be implemented in various forms and embodiments, and that it may be applied in numerous applications, only some of which have been described herein. It is intended by the following claims to claim all such modifications and variations which fall within the true scope of the invention.

What is claimed is:

1. A method comprising:

receiving a file containing a print image of a document to be printed and mailed from a document production application;

analyzing the print image to obtain mailing related information regarding the document;

calculating postage for a mail piece that will include the document based at least in part on the mailing related information;

obtaining a digital token representing the calculated postage from a postage meter;

merging an image of an indicium derived in response to the digital token into the print image of the document to form a modified print image of the document;

printing the document containing the indicium using the modified print image of the document; and inserting the printed document into an envelope in such a manner that the printed indicium is visible through a window of the envelope.

2. A method as in claim 1, wherein the indicium includes a cipher produced by encrypting at least some mailing related information obtained by analysis of the print image.

3. A method as in claim 1, further comprising repeating the steps of analyzing, calculating, obtaining and finishing in response to another print image contained in the received file.

4. A method as in claim 1, wherein the step of analyzing comprises:

analyzing the print image to obtain address information;

comparing the address information obtained from the print image to valid address information; and in response to the comparison, if the address information obtained from the print image is invalid, replacing the invalid address information in the print image with valid address information.

5. A method as in claim 4, wherein the postage is calculated at least in part based on the valid address information.

6. A method comprising:

receiving a print file containing a batch of print images, each print image representing a document to be printed and mailed;

analyzing each print image contained in the print file to obtain mailing related information regarding each document;

calculating a postage value for each document based at least in part on the mailing related information regarding each document;

obtaining a digital token representing the calculated postage for each document;

manipulating each of the print images by merging an image of an indicium developed from a respective digital token into the print image to form a modified print image and storing each of the modified print images in a modified print file; and printing each document containing the indicium developed from the respective digital token based on the modified print image from the modified print file and inserting each printed document into an envelope in such a manner that the printed indicium is visible through a window of the envelope.

7. A method as in claim 6, wherein the step of obtaining comprises generating the tokens in software.

8. A high-volume mail processing system comprising:

a computer running at least one processing application for producing a print file containing print images of a plurality of documents;

a post production processing application, running on a computer platform, for: receiving the print file, analyzing the print images, calculating postage values applicable to documents derived from the analyzed print images, obtaining digital tokens representative of valid postage in the calculated values, manipulating each of the print images by merging an image of an indicium developed from a respective digital token into the print image to form a modified print image, and processing the modified print images to produce a modified print file and a control file;

a printer responsive to the modified print file for printing the documents, each printed document containing the indicium developed from the respective digital token; and an inserter for inserting the printed documents into envelopes in such a manner that the indicium is visible through a window of the envelope.

9. A system as in claim 8, wherein the platform comprises the computer.

10. A system as in claim 8, wherein the platform is separate from and coupled to the computer.

11. A system as in claim 8, further comprising a sequence of program instructions, running on the computer or the platform, for providing the digital tokens to the post production processing application and for accounting for the postage values represented in the tokens.

12. A system as in claim 8, further comprising a secure postage metering device in communication with the post production processing application, the secure postage metering device receiving requests for the calculated values of postage from the post production processing application and in response supplying the digital tokens to the post production processing application.

13. A system as in claim 12, wherein the secure postage metering device comprises a plurality of postal security devices coupled to the platform.

14. A system as in claim 12, wherein the secure postage metering device comprises a programmable digital processor.

15. A system as in claim 14, wherein the programmable digital processor is remote from the platform.

16. A programmable computer system comprising: means for receiving a print image of a document to be printed and mailed;

means for analyzing the print image to obtain mailing related information regarding the document;

means, responsive to the obtained mailing related information, for calculating postage for a mail piece that will include the document;

means for obtaining a digital token representing the calculated postage;

means for merging an image of an indicium derived in response to the digital token into the print image of the document to form a modified print image of the document; and means for supplying the modified print image to mail piece finishing equipment for printing the document containing the indicium and for inserting the printed document into an envelope in such a manner that the indicium is visible through a window of the envelope.

17. A programmable computer system comprising:

means for receiving a print file containing a batch of print images, each print image representing a document to be printed and mailed;

means for analyzing each print image contained in the print file to obtain mailing related information regarding each document;

means for calculating a postage value for each document based at least in part on the obtained mailing related information;

means for obtaining a digital token representing the calculated postage for each document;

means for merging an image of an indicium derived in response to a respective digital token into each of the print images to form a modified print image of the document; and means for supplying the modified print images to mail piece finishing equipment for printing the documents and for inserting each of the printed documents into an envelope in such a manner that the indicium is visible through a window of the envelope.

18. A product bearing a sequence of computer executable instructions, said sequence of computer executable instructions comprising instructions for performing the steps of:

receiving a file containing a print image of a document to be printed and mailed from a document production application;

analyzing the print image to obtain mailing related information regarding the document;

calculating postage for a mail piece that will include the document based at least in part of the mailing related information;

obtaining a digital token representing the calculated postage from a postage meter;

merging an image of an indicium derived in response to the digital token into the print image of the document to form a modified print image of the document; and supplying the modified print image to enable printing of the document containing the indicium using the modified print image and inserting of the printed document into an envelope in such a manner that the indicium is visible through a window of the envelope, wherein the product comprises either a computer readable medium storing the sequence of computer executable instructions or a carrier wave carrying the sequence of computer executable instructions in computer readable form.

19. A product as in claim 18, wherein the sequence of steps further comprises repeating the steps of analyzing, calculating, obtaining and supplying in response to another print image contained in the received file.

* * * * *